US010371146B2

(12) United States Patent
Horimatsu et al.

(10) Patent No.: US 10,371,146 B2
(45) Date of Patent: Aug. 6, 2019

(54) ELECTRIC PUMP WITH PERMANENT MAGNET, CONNECTING PLATES AND PLATE HOLDERS

(71) Applicant: MAHLE FILTER SYSTEMS JAPAN CORPORATION, Tokyo (JP)

(72) Inventors: Toshinobu Horimatsu, Kawagoe (JP); Haruo Iwano, Tokyo (JP); Satoshi Masukura, Higashimatsuyama (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 97 days.

(21) Appl. No.: 15/262,474

(22) Filed: Sep. 12, 2016

(65) Prior Publication Data

US 2017/0074264 A1 Mar. 16, 2017

(30) Foreign Application Priority Data

Sep. 15, 2015 (JP) ..... 2015-181415

(51) Int. Cl.
*F04C 15/00* (2006.01)
*F04C 2/332* (2006.01)
(Continued)

(52) U.S. Cl.
CPC ..... *F04C 15/008* (2013.01); *F04C 2/332* (2013.01); *F04C 2/336* (2013.01); *F04C 11/008* (2013.01);
(Continued)

(58) Field of Classification Search
CPC ..... F04C 2/332; F04C 11/008; F04C 15/00; F04C 5/0061; F04C 15/0065; F04C 15/0069; F04C 2240/40; F04C 2/336; F04C 15/008; F04C 18/38; F04C 18/39; F04C 1/40; F04C 18/44; F04C 1/46;
(Continued)

(56) References Cited

U.S. PATENT DOCUMENTS 2,250,947 A * 7/1941 Carpenter, Jr. ..... F04B 1/0408 310/166
8,801,401 B2 8/2014 Yamashita
(Continued)

FOREIGN PATENT DOCUMENTS

JP 2012-067735 A 4/2012
JP 2015-117695 A 6/2015

*Primary Examiner* — Bryan M Lettman
(74) *Attorney, Agent, or Firm* — Foley & Lardner LLP

(57) ABSTRACT

An electric pump includes an outer rotor rotatably disposed radially inward of a stator, the outer rotor including a plurality of permanent magnets in an outer circumferential surface thereof, a plurality of plate holding grooves being formed in an inner circumferential surface of the outer rotor; an inner rotor provided radially inward of the outer rotor, a plurality of slots being radially formed in an outer circumferential surface of the inner rotor; and a plurality of connecting plates each including a head portion and a radially-inner end portion, the head portion being formed in a substantially circular shape in cross section and fitted swingably into the plate holding groove, the radially-inner end portion being slidably fitted into the slot. Each of the plate holding grooves is located within a projection plane of the permanent magnet with respect to a circumferential direction of the outer rotor.

4 Claims, 6 Drawing Sheets

(51) Int. Cl.
*F04C 2/336* (2006.01)
*F04C 11/00* (2006.01)

(52) U.S. Cl.
CPC ..... *F04C 2240/20* (2013.01); *F04C 2240/30* (2013.01); *F04C 2240/40* (2013.01)

(58) Field of Classification Search
CPC ..... F04C 29/0085; F04C 2/08; F04C 2/22; F04C 2/32; F04C 2/321; F04C 2/36
See application file for complete search history.

(56) References Cited

U.S. PATENT DOCUMENTS

| | | | | |
|---|---|---|---|---|
| 2012/0076678 | A1* | 3/2012 | Yamashita ..... | F04C 2/332 417/410.1 |
| 2015/0167666 | A1 | 6/2015 | Hoehn et al. | |

* cited by examiner

ELECTRIC PUMP WITH PERMANENT MAGNET, CONNECTING PLATES AND PLATE HOLDERS

BACKGROUND OF THE INVENTION

The present invention relates to an electric pump for liquid which is used as an oil pump or the like, more particularly to an improvement of an electric pump in which an outer rotor of a pump section is drivingly rotated as a rotor of a motor section.

Japanese Patent Application Publication No. 2012-67735 (Patent Literature 1) discloses a previously-proposed electric pump. In this technique, a principle of a rotation-type volume pump which is generally called "pendulum-type pump" or the like is used. Also as disclosed in Japanese Patent Application Publication No. 2015-117695 (Patent Literature 2), the pendulum-type pump includes an inner rotor and an outer rotor which are eccentric relative to each other. These inner rotor and outer rotor are connected with each other by a plurality of radially-disposed connecting plates such that the inner rotor can rotate together with the outer rotor. The plurality of connecting plates partition a crescent-shaped space formed between the inner rotor and the outer rotor, into a plurality of chambers. Hence, by rotating the inner rotor and the outer rotor, a pumping action similar to that of a vane pump can be obtained.

In the electric pump disclosed in Patent Literature 1, permanent magnets are provided on an outer circumferential surface of the outer rotor, and stator coils are provided radially outward of the outer rotor. This outer rotor cooperates with the stator coils to function as an electric motor. That is, the outer rotor which is a structural component of a pump section rotates by a direct drive in cooperation with the stator coils.

In the technique of Patent Literature 1, plate holding grooves are formed in an inner circumferential surface of the outer rotor in order to swingably support end portions of the connecting plates. Each permanent magnet is located between one pair of adjacent plate holding grooves with respect to a circumferential direction (i.e. when comparing those circumferential locations). In other words, the plate holding grooves do not overlap with the permanent magnets as viewed in a radial direction. That is, two connecting plates are located on circumferential both sides of each permanent magnet.

SUMMARY OF THE INVENTION

In the case of arrangement relation between the connecting plates and permanent magnets as disclosed in Patent Literature 1, a closed magnetic path is constituted by each permanent magnet, a pair of connecting plates close to circumferentially both end portions of the permanent magnet and an outer circumferential portion of the inner rotor which is located between the pair of connecting plates, if the connecting plates and the inner rotor are made of magnetic substance such as a steel. Accordingly, a part of magnetic flux of the permanent magnets does not effectively act on the stator disposed radially outward of the permanent magnets. Hence, an efficiency of rotary drive is reduced. Moreover, in this case, the inner rotor attracts the connecting plates by magnetic force. Hence, a sliding resistance which is caused with rotation at contact portions between the inner rotor and the connecting plates is large. This is also a cause of the efficiency reduction. Furthermore, the enlargement of the sliding resistance increases a torque fluctuation at the time of rotation.

It is an object of the present invention to provide an electric pump devised to solve or ease the above problem.

According to one aspect of the present invention, there is provided an electric pump comprising: a housing formed with a suction port and a discharge port and equipped with an annular stator; an outer rotor formed in a cylindrical shape and rotatably disposed radially inward of the stator, wherein the outer rotor includes a plurality of permanent magnets in an outer circumferential surface of the outer rotor such that the outer rotor cooperates with the stator to define a motor section, and a plurality of plate holding grooves formed in an inner circumferential surface of the outer rotor extend in an axial direction of the outer rotor; an inner rotor provided radially inward of the outer rotor and at an eccentric location relative to the outer rotor, wherein a plurality of slots are radially formed in an outer circumferential surface of the inner rotor, and a space formed between the inner rotor and the outer rotor communicates with the suction port and the discharge port; and a plurality of connecting plates each including a head portion and a radially-inner end portion, the head portion being formed in a substantially circular shape in cross section and fitted swingably into the plate holding groove, the radially-inner end portion being slidably fitted into the slot, the space being partitioned into a plurality of chambers by the plurality of connecting plates, wherein each of the plate holding grooves is located within a projection plane of the permanent magnet with respect to a circumferential direction of the outer rotor.

DETAILED DESCRIPTION OF THE INVENTION

Reference will hereinafter be made to the drawings in order to facilitate a better understanding of the present invention.

Figure 1:
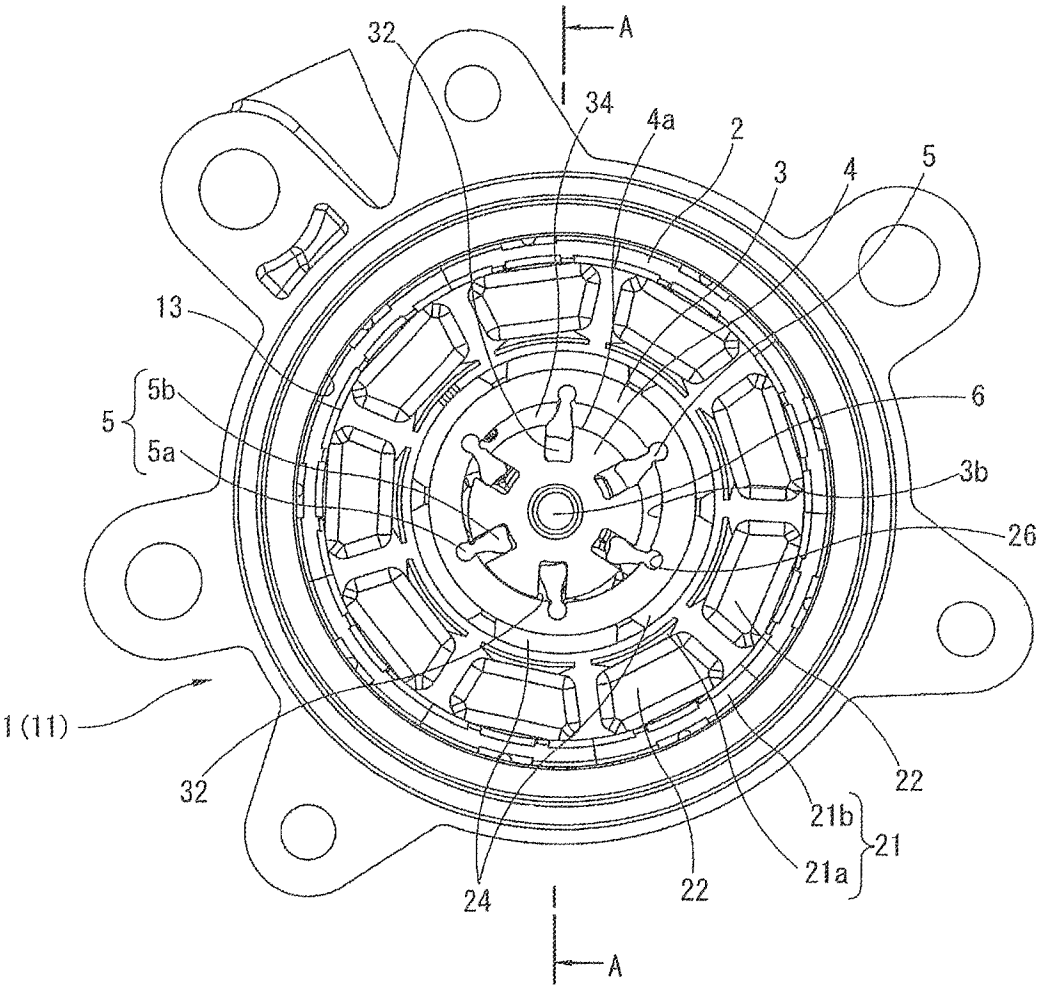
FIG. 1 is a plan view illustrating an oil pump according to the present invention in the state where a cover has been detached from the oil pump.
Figure 2:
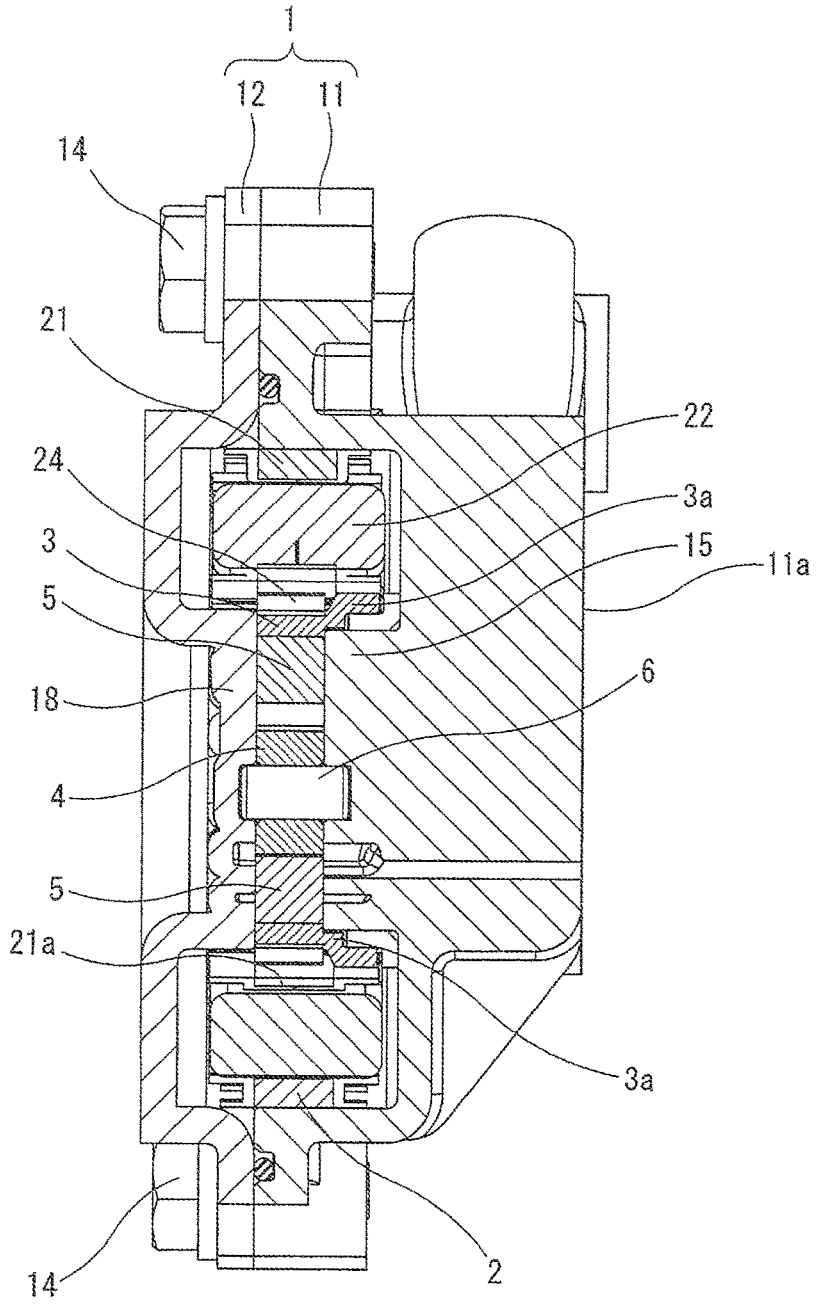
FIG. 2 is a sectional view of whole of the oil pump, taken along an A-A line of FIG. 1.
Figure 3:
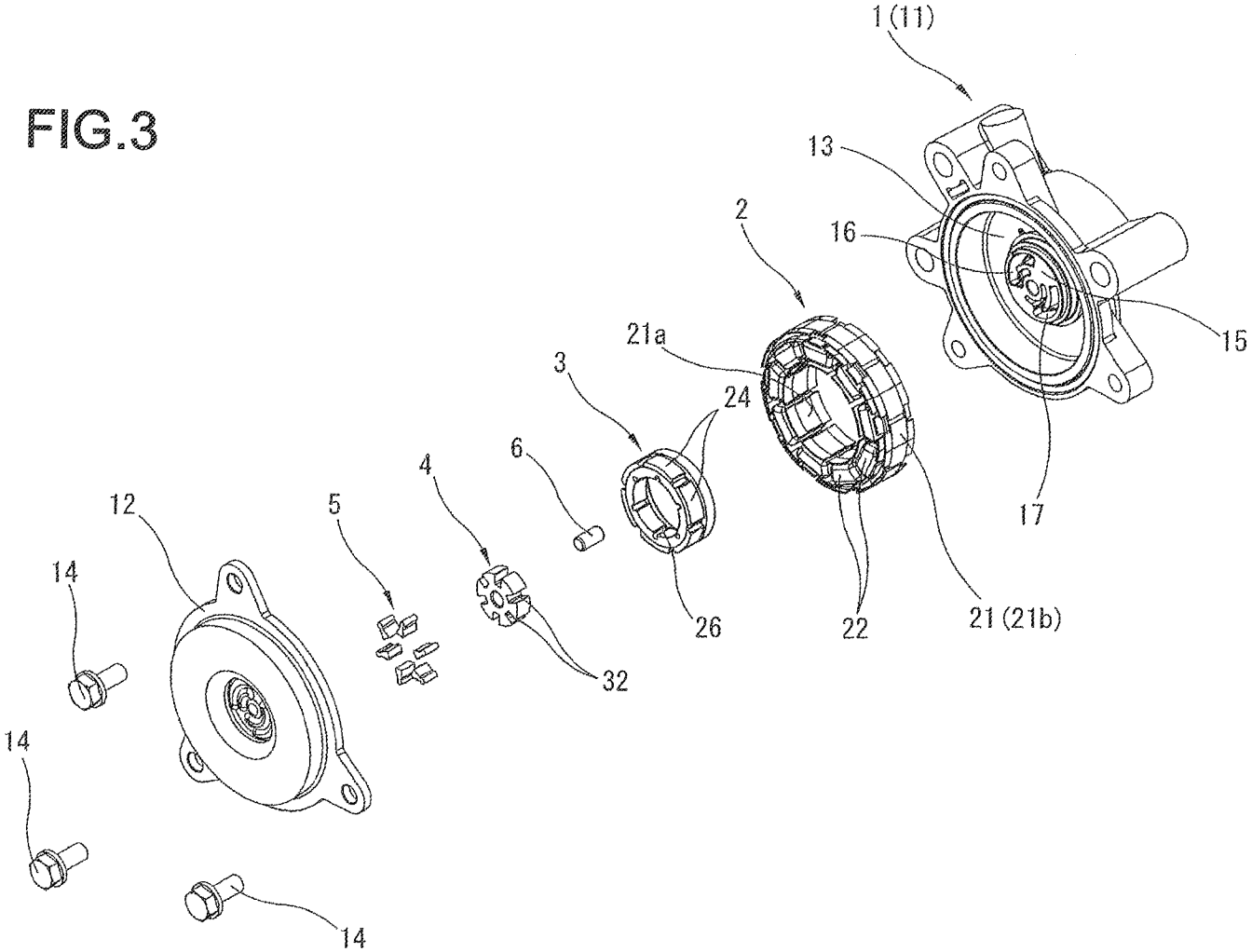
FIG. 3 is an exploded perspective view of the oil pump.

FIGS. 1 to 3 are views showing an embodiment in which the present invention has been applied to an oil pump for an automatic transmission or the like. As shown in FIG. 3, this oil pump mainly includes a housing 1, a stator 2, an outer rotor 3, an inner rotor 4, and a plurality of connecting plates 5. The housing 1 is formed in a hollow disc-shape, and is attached to a proper part of the automatic transmission or an internal combustion engine. The stator 2 is formed in an annular shape, and is accommodated in the housing 1. The outer rotor 3 is formed in a cylindrical shape (circular tube-shape), and is arranged radially inward of the stator 2 (i.e. is located on a radially inner side of the stator 2). The inner rotor 4 is arranged radially inward of the outer rotor 3 such that the inner rotor 4 is eccentric relative to the outer rotor 3. The plurality of connecting plates 5 connects the outer rotor 3 with the inner rotor 4. The number of the plurality of connecting plates 5 is, for example, six.

The housing 1 includes a main body 11 and a cover 12 which are dividable. The main body 11 is formed with a stator accommodating chamber 13 which is a concave portion. The cover 12 is combined with the main body 11 so that the cover 12 covers (encloses) an opening plane of the stator accommodating chamber 13. The main body 11 and the cover 12 are engaged with each other by a plurality of bolts 14. At a central portion of the stator accommodating chamber 13, the main body 11 includes a side plate portion 15 formed as a circular convex portion. In an end surface of the side plate portion 15, a suction port 16 and a discharge port 17 are formed. Each of the suction port 16 and the discharge port 17 is in a crescent shape. As shown in FIG. 2, also at a central portion of the cover 12, the cover 12 includes a side plate portion 18 formed as a circular convex portion. It is noted that also the side plate portion 18 of the cover 12 may be formed with a suction port and a discharge port. That is, the suction port has only to be formed in at least one of the two side plate portions 15 and 18. In the same manner, the, discharge port has only to be formed in at least one of the two side plate portions 15 and 18. Moreover, a plate member provided as a separate element from the housing 1 itself may be formed with the suction port and/or the discharge port.

A rotation shaft 6 rotatably supports the inner rotor 4. Both end portions of the rotation shaft 6 are supported respectively by the side plate portion 15 provided to the main body 11 and the side plate portion 18 provided to the cover 12. The rotation shaft 6 has an eccentric center relative to centers of the circular side plate portions 15 and 18. It is noted that a wording "axial direction" in a description of the present application means a direction parallel to a central axis of the rotation shaft 6.

The stator 2 and the outer rotor 3 are structural components that define a motor section. The stator 2 includes a stator core 21 (for example, nine-slot stator core) and coils 22. The stator core 21 is a laminated iron core. The stator core 21 includes a plurality of poles 21*a* (for example, nine poles) and an annular yoke 21*b*. Each of the coils 22 is wound around the corresponding one of the poles 21*a*. The stator 2 is arranged to coaxially surround the side plate portions 15 and 18, in the stator accommodating chamber 13 of the housing 1.

The outer rotor 3 constitutes a rotor of the motor section. Moreover, the outer rotor 3 cooperates with the inner rotor 4 to define a pump section. The outer rotor 3 is formed in a cylindrical shape (circular tube-shape) by using a metallic material such as an iron-based material that is a magnetic substance. A plurality of permanent magnets 24 (for example, six permanent magnets) are attached to an outer circumferential surface of the outer rotor 3 at even intervals. Each of the plurality of permanent magnets 24 is in the form of a plate curved in an arc-shape. These permanent magnets 24 are aligned such that north pole and south pole thereof are alternately arranged in a circumferential direction of the outer rotor 3. By such arrangements, the permanent magnets 24 cooperate with the stator 2 to realize the motor section. The permanent magnets 24 face inner circumferential surfaces of the poles 21*a* of the stator 2 through a slight air gap. Moreover, the outer rotor 3 includes a bearing portion 3*a* (see FIG. 2) at axially one end portion of the cylindrical outer rotor 3. The bearing portion 3*a* has a diameter slightly greater than a diameter of (a major part of) the cylindrical outer rotor 3. This bearing portion 3*a* is rotatably fitted over an outer circumferential portion of the side plate portion 15 of the main body 11. Accordingly, the outer rotor 3 is rotatably supported by the housing 1. In this example shown by the drawings, the permanent magnets 24 adhere to the outer circumferential surface of the cylindrical outer rotor 3 made of iron-based material. However, according to the present invention, the outer rotor 3 may be molded of a rigid synthetic resin, and the permanent magnets 24 may be buried in the outer rotor 3.

In an inner circumferential surface 3*b* of the outer rotor 3, a plurality of plate holding grooves 26 (for example, six holding grooves) are formed at even intervals. Each of the plurality of plate holding grooves 26 is recessed (depressed) in a circular shape or a C-shape in cross section. Each of the plurality of plate holding grooves 26 extends in an axial direction of the outer rotor 3. Each of the plurality of plate holding grooves 26 has both ends which are respectively open to axially end surfaces of the outer rotor 3.

If the permanent magnet 24 disposed on the outer circumferential surface of the outer rotor 3 is imaginarily projected onto the inner circumferential surface 3*b* of the outer rotor 3 in a radial direction of the outer rotor 3, a circumferential location of each of the plate holding grooves 26 is within a projection plane (projection shape) of the permanent magnet 24. In particular, each of the plate holding grooves 26 is located at a circumferential center of the projection plane of the permanent magnet 24.

The inner rotor 4 disposed radially inward of the outer rotor 3 is formed in a substantially disc-shape by using a metallic material such as an iron-based material that is a magnetic substance. The inner rotor 4 has a mounting hole 28 formed at a center of the inner rotor 4. The mounting hole 28 is rotatably fitted over the rotation shaft 6 located eccentrically relative to the outer rotor 3. Hence, the inner rotor 4 is eccentric (i.e. has a deviated center) from the outer rotor 3 such that a circumferential part of an outer circumferential surface 4*a* of the inner rotor 4 is closer to the inner circumferential surface 3*b* of the outer rotor 3. It is noted that the rotation shaft 6 may be fixed to the inner rotor 4 and rotatably supported by the housing 1.

In the outer circumferential surface 4*a* of the inner rotor 4, six rectangular slots 32 are formed at circumferentially even intervals. That is, the number of slots 32 corresponds to the number of plate holding grooves 26. Each of the six slots 32 extends in a radial direction of the inner rotor 4. Moreover, each of the six slots 32 extends in the axial direction of the inner rotor 4 such that axially both ends of each slot 32 are open to axially end surfaces of the inner rotor 4.

As mentioned above, the inner rotor 4 is eccentric relative to the inner circumferential surface 3*b* of the outer rotor 3. As a result, a crescent-shaped space is formed between the outer rotor 3 and the inner rotor 4, as shown in FIG. 1. This crescent-shaped space is divided (partitioned) into six chambers 34 by the six connecting plates 5. Each of the connecting plates 5 is in the form of a plate, and has a so-called pendulum-type shape in cross section which is near a triangular shape. Each connecting plate 5 includes a head portion 5*a* and a swelling portion 5*b*. The head portion 5*a* is located at a radially outer end of the connecting plate 5, and has a circular shape in cross section. The swelling portion 5*b* is located at a radially inner side of the connecting plate 5, and swells (bulges) in the circumferential direction of the inner rotor 4. Each head portion 5*a* is swingably fitted into the plate holding groove 26 of the outer rotor 3. Each swelling portion 5*b* is slidably inserted into the slot 32 of the inner rotor 4. Each of the connecting plates 5 is also formed of a metallic material such as an iron-based material that is a magnetic substance, in consideration of a strength and an abrasion resistance.

As easily understood from FIG. 1, a distance between the inner circumferential surface 3*b* of the outer rotor 3 and the outer circumferential surface 4*a* of the inner rotor 4 varies according to a rotational position of the outer rotor 3 and the inner rotor 4 which are eccentric relative to each other. Hence, a volume of each chamber 34 separately formed by the connecting plates 5 is increased and decreased according to the rotational position. Therefore, when the outer rotor 3 and the inner rotor 4 rotate in a clockwise direction of FIG. 1, a pumping action that pressurizes and feeds oil from the suction port 16 provided in the side plate portion 15, 18 to the discharge port 17 provided in the side plate portion 15, 18 can be produced.

In the above-mentioned oil pump, the motor section constituted by the stator 2 and the outer rotor 3 equipped with the permanent magnets 24 drivingly rotates the outer rotor 3, so that the inner rotor 4 rotates to follow the outer rotor 3 through the connecting plates 5. Specifically, in the above embodiment, the nine poles 21*a* and the six permanent magnets 24 construct a three-phase six-pole nine-slot motor section. Hence, the outer rotor 3 can be rotated in the stator 2 at an arbitrary speed by driving the coils 22 through a proper motor drive circuit which has an inverter. Therefore, the oil pump in this embodiment is suitable, for example, as an electric oil pump for an automatic transmission of a hybrid vehicle.

As explained above, each of the permanent magnets 24 arranged on the outer circumferential surface of the outer rotor 3 takes a circumferential location which radially overlaps with the connecting plate 5 disposed on the radially inner side of the outer rotor 3. That is, if the permanent magnets 24 arranged on the outer circumferential surface of the outer rotor 3 are imaginarily projected in the radial direction, each of the plate holding grooves 26 formed in the inner circumferential surface 3*b* of the outer rotor 3 has a circumferential location which falls within the projection plane of one of the permanent magnets 24. In particular, each of the plate holding grooves 26 is located at a center of the projection plane of the permanent magnet 24 with respect to the circumferential direction. By such arrangements, a leakage of magnetic flux of the permanent magnets 24 which is introduced through the connecting plates 5 is reduced. Moreover, a magnetization of the connecting plates 5 is suppressed. Hence, in each contact portion between the connecting plate 5 and the plate holding groove 26 and each contact portion between the connecting plate 5 and the slot 32, an increase of sliding resistance due to magnetic force is suppressed. Accordingly, an efficiency of the motor section, i.e. an efficiency of the oil pump is improved.

Figure 4:
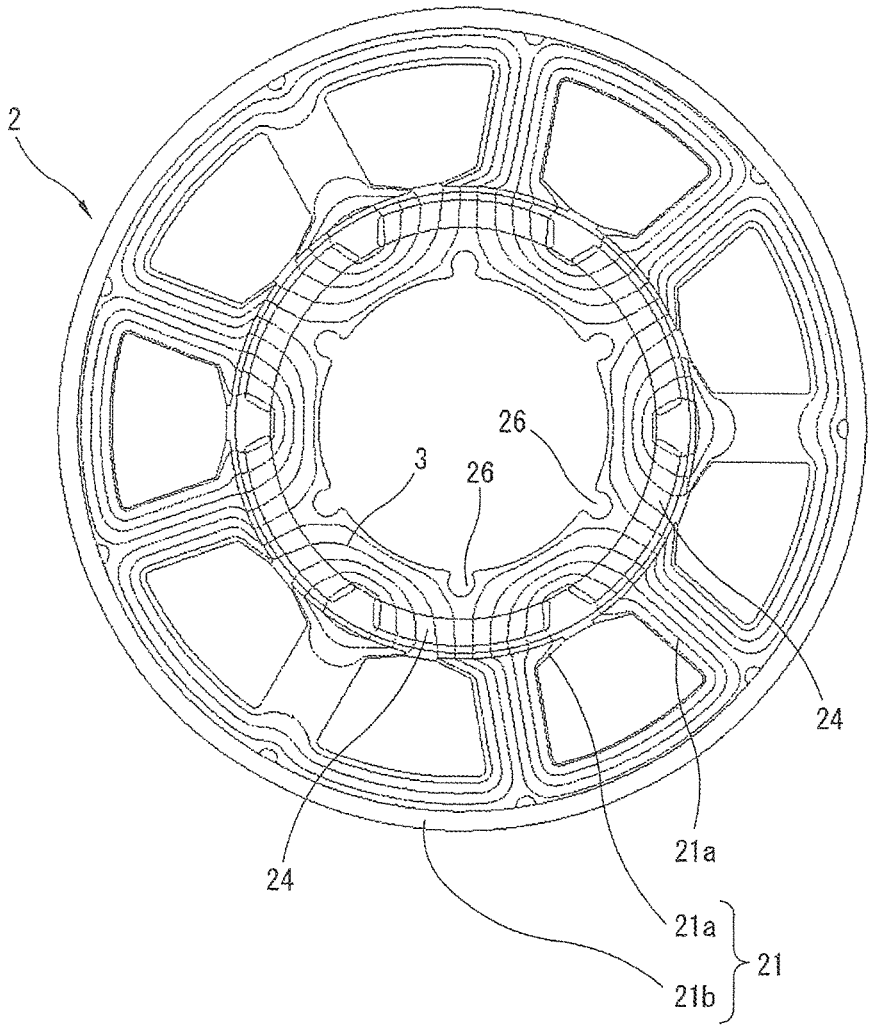
FIG. 4 is an explanatory view illustrating a flow of magnetic flux of permanent magnets.

The concrete explanation is as follows. FIG. 4 shows magnetic flux of the permanent magnets 24 which flows in the stator 2 under the condition that the coils 22 are not in an excited state. Individual permanent magnet 24 is formed such that an outer circumferential surface thereof is the north pole whereas an inner circumferential surface thereof is the south pole, or such that the outer circumferential surface thereof is the south pole whereas the inner circumferential surface thereof is the north pole. The six permanent magnets 24 formed in such a manner are aligned so as to alternately locate the north pole and the south pole in the circumferential direction. Accordingly, in the case that the inner circumferential surface of a certain first permanent magnet 24 among the six permanent magnets 24 is the north pole, magnetic flux derived from this north pole mainly flows from an inner circumferential surface of a circumferentially end portion of the first permanent magnet 24 through an inside of the outer rotor 3 toward an inner circumferential surface (south pole) of an end portion of an adjacent second permanent magnet 24. Then, the magnetic flux flows from a circumferentially end portion of an outer circumferential surface (north pole) of the second permanent magnet 24, through an adjacent pole 21*a* (which is closest to the second permanent magnet 24) and the yoke 21*b*, to a pole 21*a* closest to an outer circumferential surface (south pole) of the end portion of the first permanent magnet 24. Then, the magnetic flux returns to the first permanent magnet 24. In other words, a closed magnetic path is constituted by two permanent magnets 24 (the first permanent magnet 24 and the second permanent magnet 24) which are adjacent to each other, two poles 21*a* located near these two permanent magnets 24, and the yoke 21*b* located between these two poles 21*a*. Hence, plenty of magnetic flux flows in this closed magnetic path.

As mentioned above, respective closed magnetic paths are constituted by regarding circumferentially end portions of the permanent magnets 24 as starting points or ending points. Each of the plate holding grooves 26 (and end portions of the connecting plates 5) formed on the inner circumferential side of the outer rotor 3 is located at a circumferential center of the above-mentioned projection plane of the permanent magnet 24. Hence, as easily perceived from FIG. 4, magnetic flux which goes from the plate holding grooves 26 toward the connecting plates 5 is very small. That is, although a continuous magnetic path in magnetic substances is constituted by the inner rotor 4 and two connecting plates 5 attached to the adjacent two plate holding grooves 26, little magnetic flux flows.

Therefore, an efficiency reduction due to magnetic flux leakage of the permanent magnets 24 is small. Moreover, the increase of sliding resistance due to magnetization of the connecting plates 5 is suppressed.

Figure 5:
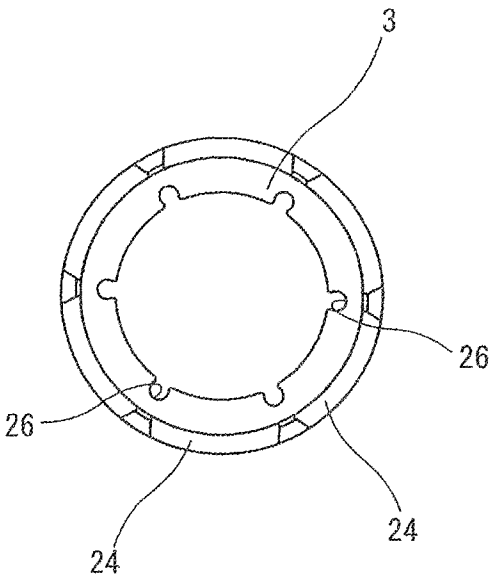
FIG. 5 is an explanatory view illustrating a comparative example.

Contrary to the above embodiment, FIG. 5 shows a comparative example. In this comparative example, each of the plate holding grooves 26 (and end portions of the connecting plates 5) is located between a pair of permanent magnets 24 with respect to the circumferential direction. In other words, the plate holding grooves 26 are located outside of the projection planes of the permanent magnets 24 with respect to the circumferential direction. Hence, a closed magnetic path is constituted by each permanent magnet 24, a pair of connecting plates 5 formed of a magnetic substance and located near circumferential both end portions of this permanent magnet 24, and an outer circumferential portion of the inner rotor 3 formed of a magnetic substance and located between the pair of connecting plates 5. Hence, a part of magnetic flux of the permanent magnet 24 leaks into this closed magnetic path. Accordingly, the efficiency of the electric motor is reduced. Moreover, because the connecting plates 5 become magnetized, the sliding resistance is increased in sliding portions between the connecting plates 5 and the plate holding grooves 26 and in sliding portions between the connecting plates 5 and the slots 32. This results in a reduction in pump efficiency and an increase in torque fluctuation at the time of rotation.

In the above embodiment according to the present invention, each of the plate holding grooves 26 is formed at a circumferentially center location of the projection plane of the permanent magnet 24. However, even in the case that each plate holding groove 26 is formed at a location somewhat shifted from the circumferentially center location of the projection plane, the magnetic flux which leaks through the connecting plates 5 is small as long as each plate holding groove 26 is located within the projection plane of the permanent magnet 24. In the case that the plate holding groove 26, i.e. the end portion of the connecting plate 5 is located outside of the projection plane (projection shape) of the permanent magnet 24, a leaking magnetic flux is very large.

Moreover, in the above embodiment, edge lines of circumferentially both end of each permanent magnet 24 are parallel to the central axis of the outer rotor 3. That is, in the above embodiment, a skew angle is equal to 0. However, the present invention is applicable also to the case that the permanent magnets 24 are arranged to have some skew angle. In this case, the plate holding groove 26 has only to be located within a projection plane of the skewed permanent magnet 24.

Moreover, the present invention is not limited to the three-phase six-pole nine-slot structure as described in the above embodiment. According to the present invention, the number of poles of the permanent magnets 24 and the number of slots 32 can be set appropriately.

Moreover, according to the present invention, the number of connecting plates 5 (in other words, the number of plate holding grooves 26) can take any value. In the above embodiment, the number of connecting plates 5 is equal to the number of permanent magnets 24. However, according to the present invention, the number of connecting plates 5 does not have to be equal to the number of permanent magnets 24 as long as the plate holding grooves 26 can be disposed within the range of the projection planes (projection shapes) of the permanent magnets 24.

As one most typical example, the number of permanent magnets 24 is an integer multiple (integer times) of the number of connecting plates 5 (the number of plate holding grooves 26). In such a case, all the plate holding grooves 26 can be disposed within the range of the projection planes of the permanent magnets 24.

Figure 6:
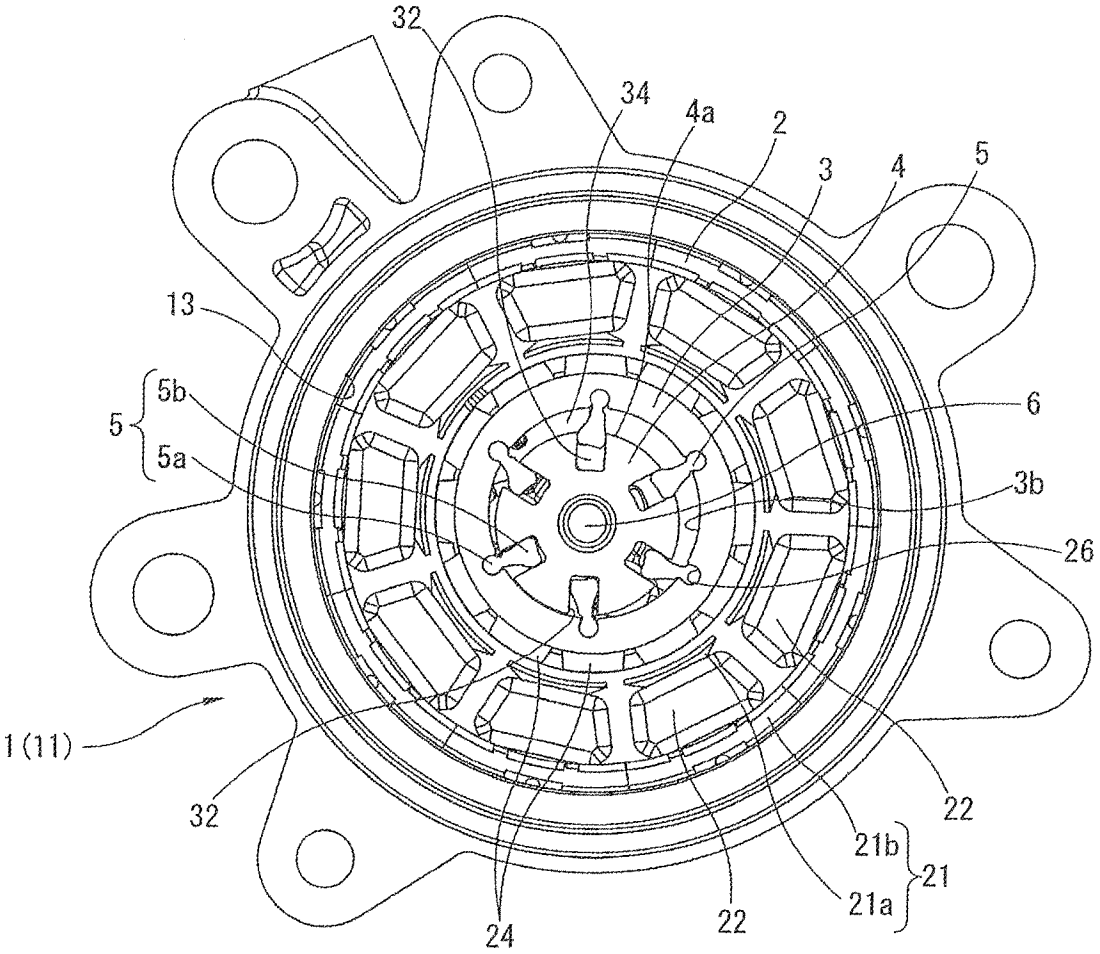
FIG. 6 is a plan view illustrating a second embodiment according to the present invention, in the same manner as FIG. 1.

As an example, FIG. 6 shows another embodiment in which six connecting plates 5 and twelve permanent magnets 24 are provided. It is noted that the stator 2 has nine slots in the same manner as the above embodiment. In the structure of FIG. 6, the plate holding groove 26 is formed at a location corresponding to every other permanent magnet 24. Also in this embodiment, each of the plate holding grooves 26 is located within the projection plane of the permanent magnet 24. In particular, each of the plate holding grooves 26 is formed at a circumferential center of the projection plane of the permanent magnet 24. Therefore, magnetic flux which leaks into the connecting plates 5 is small in the same manner as the above embodiment.

Although the invention has been described above with reference to certain embodiments of the invention, the invention is not limited to the embodiments described above. Modifications and variations of the embodiments described above will occur to those skilled in the art in light of the above teachings.

Some technical configurations obtainable from the above embodiments according to the present invention will now be listed with their advantageous effects.

[a] An electric pump comprising: a housing (e.g. reference sign 1 in the drawings) formed with a suction port (16) and a discharge port (17) and equipped with an annular stator (2); an outer rotor (3) formed in a cylindrical shape and rotatably disposed radially inward of the stator (2), wherein the outer rotor includes a plurality of permanent magnets (24) in an outer circumferential surface of the outer rotor such that the outer rotor cooperates with the stator to define a motor section, and a plurality of plate holding grooves (26) formed in an inner circumferential surface (3*b*) of the outer rotor extend in an axial direction of the outer rotor; an inner rotor (4) provided radially inward of the outer rotor and at an eccentric location relative to the outer rotor, wherein a plurality of slots (32) are radially formed in an outer circumferential surface of the inner rotor, and a space formed between the inner rotor and the outer rotor communicates with the suction port and the discharge port; and a plurality of connecting plates (5) each including a head portion (5*a*) and a radially-inner end portion (5*b*), the head portion being formed in a substantially circular shape in cross section and fitted swingably into the plate holding groove, the radially-inner end portion being slidably fitted into the slot (32), the space being partitioned into a plurality of chambers (34) by the plurality of connecting plates, wherein each of the plate holding grooves is located within a projection plane of the permanent magnet with respect to a circumferential direction of the outer rotor.

According to such a configuration, the magnetic flux of the permanent magnets mainly flows from the circumferential end portion of each permanent magnet toward the circumferential end portion of adjacent permanent magnet. Hence, magnetic flux which flows toward the inner rotor through the connecting plates is small. Hence, magnetic flow which does not contribute to a torque generation in cooperation with the stator is small. The sliding resistance between the connecting plates and the inner rotor is inhibited from increasing due to magnetic force. As a result, rotation efficiency is improved. Therefore, even in the case that the connecting plates and the inner rotor are made of magnetic substances, magnetic flux which flows from the connecting plates to the inner rotor is small, so that the efficiency of rotary drive is improved. It is noted that the above-mentioned "projection plane of permanent magnet" means an outline shape of the permanent magnet on the inner circumferential surface of the cylindrical outer rotor when an actual shape of the permanent magnet arranged on the outer circumferential surface of the cylindrical outer rotor is (imaginarily) radially projected onto the inner circumferential surface of the cylindrical outer rotor.

[b] As a more favorable aspect, the electric pump as described in the above item [a], wherein each of the plate holding grooves is located at a circumferential center of the projection plane of the permanent magnet. In such a structure, each of the connecting plates is located at the circumferential center of the permanent magnet. Accordingly, magnetic flux which flows through the connecting plates is minimized.

This application is based on a prior Japanese Patent Application No. 2015-181415 filed on Sep. 15, 2015. The entire contents of this Application are hereby incorporated by reference.

The scope of the invention is defined with reference to the following claims.

What is claimed is:

1. An electric pump comprising:

a housing formed with a suction port and a discharge port and equipped with an annular stator;

an outer rotor formed in a cylindrical shape and rotatably disposed radially inward of the stator, wherein the outer rotor includes a plurality of permanent magnets in an outer circumferential surface of the outer rotor such that the outer rotor cooperates with the stator to define a motor section, and a plurality of plate holding grooves formed in an inner circumferential surface of the outer rotor extend in an axial direction of the outer rotor;

an inner rotor provided radially inward of the outer rotor and at an eccentric location relative to the outer rotor, wherein a plurality of slots are radially formed in an outer circumferential surface of the inner rotor, and a space formed between the inner rotor and the outer rotor communicates with the suction port and the discharge port; and a plurality of connecting plates each including a head portion and a radially-inner end portion, the head portion being formed in a substantially circular shape in cross section and fitted swingably into a respective plate holding groove of the plurality of plate holding grooves, the radially-inner end portion being slidably fitted into a respective slot of the plurality of slots, the space being partitioned into a plurality of chambers by the plurality of connecting plates, wherein each of the plate holding grooves is located within a projection plane of a permanent magnet of the plurality of permanent magnets with respect to a circumferential direction of the outer rotor, and wherein the plurality of permanent magnets are fixed in position so as to be attached to an outer circumferential surface of the outer rotor at even intervals from each other.

2. The electric pump as claimed in claim 1, wherein a number of said connecting plates is equal to the number of permanent magnets.

3. The electric pump as claimed in claim 1, wherein a number of said permanent magnets is an integer multiple of the number of connecting plates.

4. The electric pump as claimed in claim 1, wherein each of the plate holding grooves is located at a center of the projection plane of the permanent magnet of the plurality of permanent magnets with respect to the circumferential direction of the outer rotor.

* * * * *